US005397542A

United States Patent [19]

Nelms et al.

[11] Patent Number: 5,397,542

[45] Date of Patent: Mar. 14, 1995

[54] SPECIMEN TUBE TRANSFER CARRIER

[75] Inventors: George E. Nelms, Edina; Charles Eumurian, Mahtomedi, both of Minn.

[73] Assignee: AutoMed, Inc., Arden Hills, Minn.

[21] Appl. No.: 283,395

[22] Filed: Jul. 29, 1994

Related U.S. Application Data

[63] Continuation of Ser. No. 913,589, Jul. 14, 1992, abandoned.

[51] Int. Cl.[6] ..... B01L 9/00

[52] U.S. Cl. ..... 422/104; 422/99; 422/102; 422/103; 436/47; 220/23.4

[58] Field of Search ..... 422/99, 104, 63, 65, 422/103, 102; 436/47; 211/71, 74; 220/23.4

[56] References Cited

U.S. PATENT DOCUMENTS

| | | | |
|---|---|---|---|
| 3,350,946 | 12/1964 | Isreeli | 73/423 |
| 3,854,879 | 12/1974 | Figueroa et al. | 23/230 R |
| 3,883,308 | 5/1975 | Matte | 23/259 |
| 3,909,203 | 9/1975 | Young et al. | 23/253 R |
| 4,480,745 | 11/1984 | Loge et al. | 211/71 |
| 4,542,930 | 9/1985 | Adams | 220/23.4 |
| 4,595,562 | 6/1986 | Liston et al. | 422/65 |
| 4,692,308 | 9/1987 | Riley et al | 422/65 |
| 4,861,553 | 8/1989 | Mawhirt et al. | 422/65 |
| 4,873,633 | 10/1989 | Mezei et al. | 364/413.08 |
| 4,919,296 | 4/1990 | Kirsh et al. | 220/23.4 |
| 4,944,924 | 7/1990 | Mawhirt et al. | 422/104 |
| 5,008,082 | 6/1991 | Shaw | 436/47 |
| 5,050,755 | 9/1991 | Strawder | 220/23.4 |
| 5,137,693 | 8/1992 | Mawhirt | 422/99 |

FOREIGN PATENT DOCUMENTS

| | | |
|---|---|---|
| 0313977 | 3/1989 | European Pat. Off. . |
| 0313977A2 | 5/1989 | European Pat. Off. . |
| 0341587A3 | 11/1989 | European Pat. Off. . |
| 0414644A3 | 2/1991 | European Pat. Off. . |
| 2391128A | 12/1978 | France . |
| 0125996 | 11/1984 | France . |

*Primary Examiner*—Donald E. Czaja
*Assistant Examiner*—Lien Tran
*Attorney, Agent, or Firm*—Klarquist Sparkman Campbell Leigh & Whinston

[57] ABSTRACT

A single cavity specimen test tube carrier especially adapted to connect to like carriers along one axis or a different axis or in a matrix. The carrier includes a test tube holder, a viewing slot, a side-to-side coupling mechanism and a front-to-back joining mechanism to attach the carriers together along a specified axis or in a matrix. The side-to-side coupling mechanism includes a boss and boss receiving cavity which snap together in a force fit. The front-to-back joining mechanism includes a plurality of knob-like protrusions that fit snugly into the viewing slot of an adjacent carrier and a horizontal bar that slides under a corresponding ledge of the adjacent carrier.

6 Claims, 4 Drawing Sheets

SPECIMEN TUBE TRANSFER CARRIER

This application is a continuation of application Ser. No. 07/913,589, filed on Jul. 14, 1992, now abandoned.

FIELD OF THE INVENTION

The present invention broadly relates to an apparatus for transferring test tubes containing liquid specimens from one location to another in laboratories or medical facilities. More specifically, the present invention relates to a single cavity test tube carrier which can be joined with other single cavity carriers to form multiple cavity carriers along a single axis, or which alternatively can be formed in matrices of manageable sizes.

BACKGROUND OF THE INVENTION

Test tubes perform a vital function in the operation of any laboratory or medical facility. For instance, test tubes store liquid or solid specimens that are used by the medical community for analyzing and treating medical problems. Generally, test tubes are handled rather frequently as they are filled, stoppered, labeled, sorted, processed, unstoppered and re-stoppered as the contents are analyzed, emptied and perhaps cleaned for reuse.

Test tubes are generally cylindrical in shape, varying in diameter and length and may be made of either glass or synthetic resins. The cylindrical shape and varying size often make it difficult to grasp a test tube firmly. Difficulty in grasping, combined with the need for frequent handling, often results in breakage of the test tubes and/or spillage of the tubes' contents.

Test tubes often are transported and stored at medical facilities in test tube carriers. Conventional test tube carriers typically comprise single unit containers having multiple test tube cavities for holding a number of test tubes. The fixed size and inflexible orientation of conventional multiple cavity carriers detracts from their ability to be handled by automatic handling equipment. As a result, test tubes stored in conventional carriers often need to be manually removed from the carrier for examining, sorting and then must be manually replaced in the carrier. Such manual manipulation of the test tubes is time and labor intensive.

A test tube carrier that would hold test tubes securely, would permit grouping of the test tubes in various physical directions and formations for processing in automatic equipment and which would permit viewing of the test tube contents or labels without the need for removal of individual test tubes from the test tube carrier would increase productivity and decrease test tube damage and specimen spillage.

SUMMARY OF THE INVENTION

The problems outlined above are in large measure solved by the single cavity specimen test tube carrier in accordance with the present invention. The test tube carrier hereof is specially adapted to be linked to other single cavity test tube carriers to form lines or matrices for storage and transportation. In addition, the test tube carrier in accordance with the present invention permits viewing of the contents of the test tube or a test tube label through a viewing slot in one face of the test tube carrier.

The test tube carrier hereof broadly includes a test tube holder with a viewing slot, a side-to-side coupling mechanism and a front-to-back joining mechanism. The coupling mechanism includes flattened round projections on one side of the test tube carrier and flexible receptacles on the opposite side of the test tube carrier for receiving the projections in a force fit. The round projections on the side of one carrier can be mated to the receptacles on the side of a second carrier, and so on, to form a row of carriers of a desired length.

The joining mechanism includes rectangular protrusions and a horizontal bar along the back of the carrier, opposite the viewing slot on the front of the carrier. The rectangular protrusions on one carrier can be fit into the front viewing slot of a second carrier to join the carriers together in a column. The horizontal bar on the back of the first carrier fits snugly underneath a ledge along the front of the second carrier.

Matrices are formed by connecting the carriers with both the side-to-side coupling mechanism and front-to-back joining mechanism into a matrix of desired size.

DETAILED DESCRIPTION OF THE INVENTION

Figure 1:
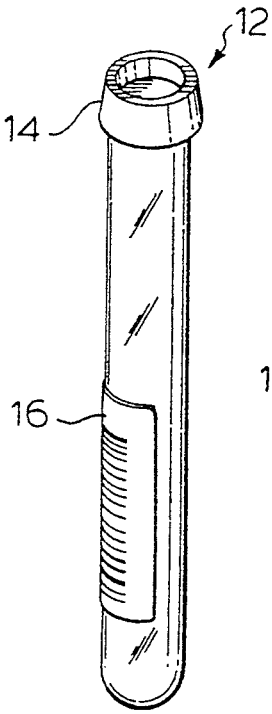
FIG. 1 is a perspective view of a large test tube.
Figure 2:
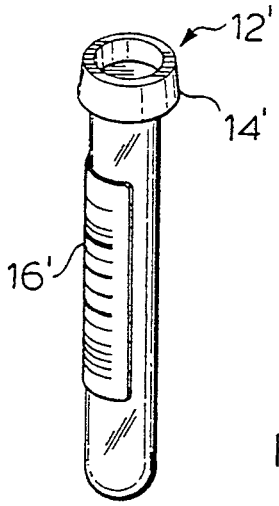
FIG. 2 is a perspective view of a small test tube.

Reference is now made to the drawings, wherein like reference numerals denote like elements throughout the several views. The test tube carrier 10 in accordance with the present invention is depicted in various ones of the figures with a test tube 12 carried within. Referring to FIG. 1, a large test tube 12 is depicted, plugged by a stopper 14 and with a bar code label 16 attached to the side of the test tube 12. Referring to FIG. 2, a smaller test tube 12 is depicted which likewise includes a stopper 14' and label 16'.

Figure 3:
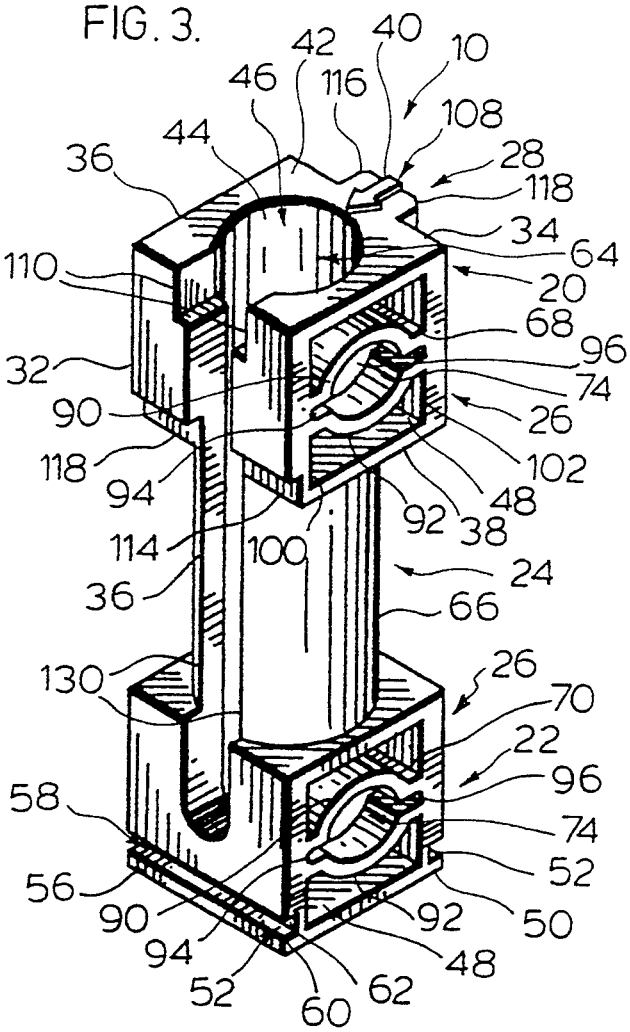
FIG. 3 is a right side perspective view of a test tube carrier in accordance with the present invention.
Figure 4:
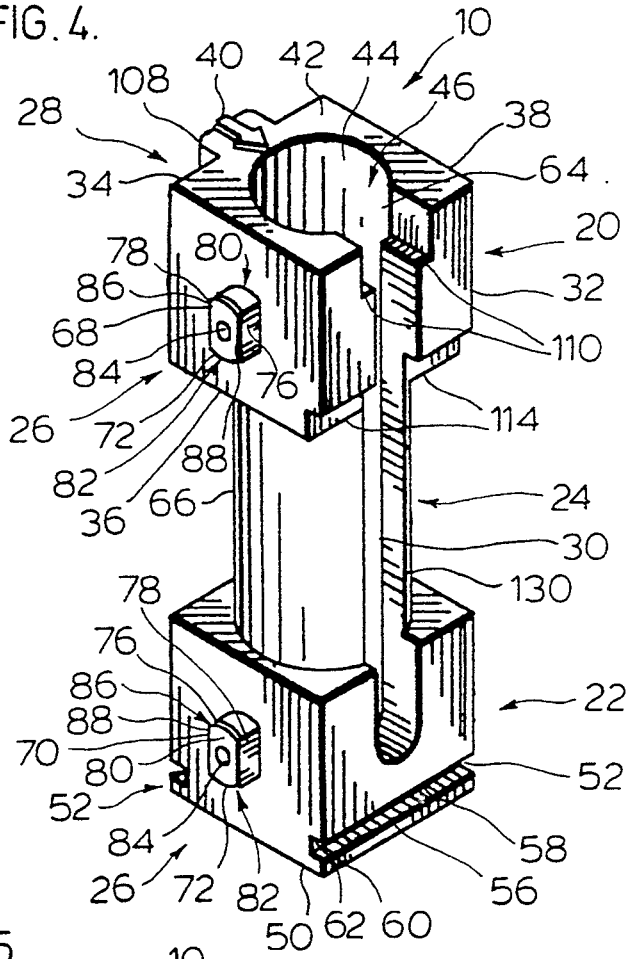
FIG. 4 is a left side perspective view thereof.

Referring to FIGS. 3 and 4, the test tube carrier 10 is a unitary piece and broadly includes an upper portion 20, a base 22, a mid-portion 24 extending between the upper portion 20 and base 22, a side-to-side coupling mechanism 26, front-to-back joining mechanism 28 and a viewing slot 30.

For ease of discussion, the front 32 of the test tube carrier 10 is designated as the face of the test tube carrier carrying the viewing slot 30. The back face 34 of the test tube carrier 10 is the face opposed to the front face 32. The left face 36 and right face 38 of the test tube carrier 10 are designated as right and left while viewing the front face 32 of the test tube carrier 10. It is understood that the designations front, back, right, and left may be changed as the orientation of the test tube carrier 10 varies.

The upper portion 20 is formed by exterior surfaces presenting a generally cube-like shape with an embossed arrow 40 carried on the upper planar surface 42. A generally cylindrical interior surface 44 defines the upper portion of a test tube receiving cavity 46. A generally square recessed opening 48 is presented by the upper portion 20 on the right face 38 of the carrier 10. The embossed arrow 40 extends from the back face 34 to the interior surface 44.

Figure 5:
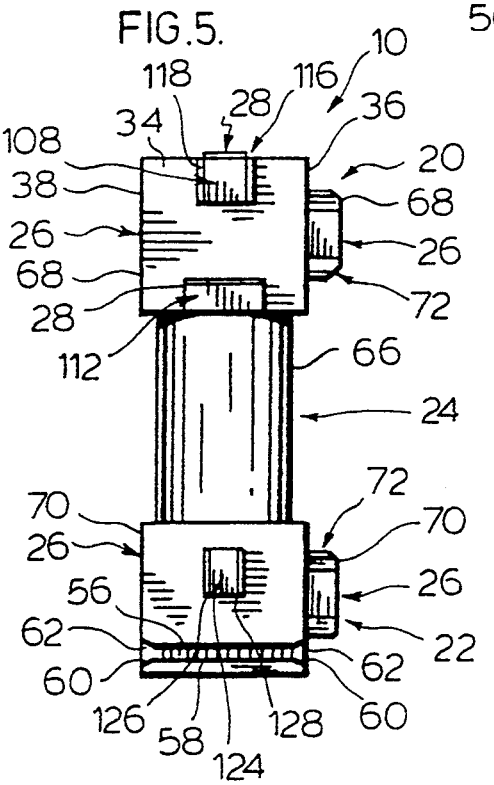
FIG. 5 is a rear elevational view of the carrier.
Figure 6:
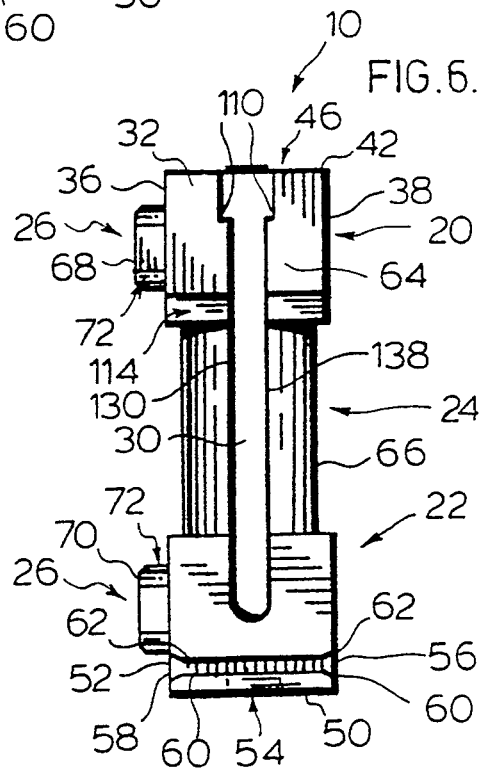
FIG. 6 is a front elevational view of the carrier.
Figure 7:
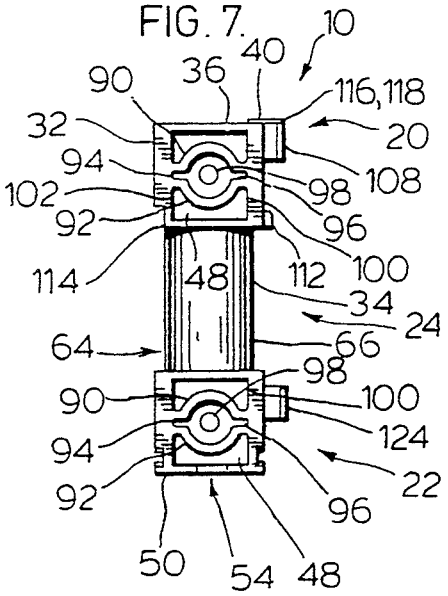
FIG. 7 is a left side elevational view of the carrier.
Figure 8:
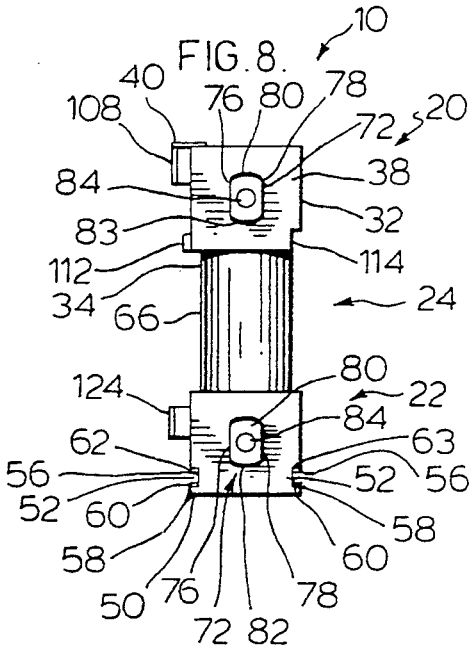
FIG. 8 is a right side elevational view of the carrier.
Figure 9:
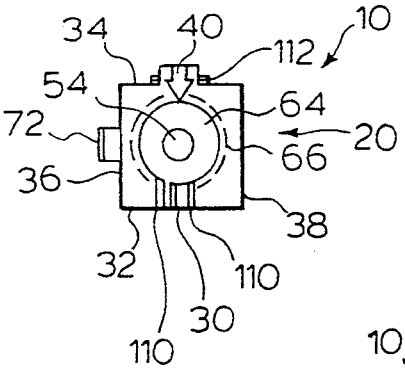
FIG. 9 is a top plan view of the carrier.

The base 22 is a generally cube-like shape with a planar bottom floor 50 and generally square recessed opening 48 presented on the right face 38 of the carrier 10. The base 22 broadly includes the lower portion of the test tube receiving cavity 46 and opposed track receiving grooves 52. Referring to FIG. 6, the lower portion of the test tube receiving cavity 46 includes a drainage passage 54 extending from the cavity 46 through the floor 50 of the base 22. Referring to FIGS. 5 and 6, the opposed track receiving grooves 52 each include opposed horizontal track walls 56, 58 with outwardly flared ends 60, 62.

The mid-portion 24 includes the mid-portion of test tube receiving cavity 46 defined by a cylindrical test tube receiving bore 64 extending from the upper portion 20 to the base 22. An outer cylindrical surface 66 of mid-portion 24 generally extends around the test tube receiving bore 64.

The side-to-side coupling mechanism 26 includes an upper coupling mechanism 68 carried by the upper portion 20 and a lower coupling mechanism 70 carried by the base 22.

The upper coupling mechanism 68 and the lower coupling mechanism 70 each include a boss 72 positioned along the left face 36 of the test tube carrier 10, and an opposed boss receiving cavity 74 positioned within the recessed opening 48. Each boss 72 broadly includes opposed vertical, side surfaces 76, 78, opposed upper and lower curved surfaces 80, 82 and a circular indentation 84. The upper and lower curved surfaces 80, 82 include a beveled edge 86 along the margin between the curved surfaces 80, 82 and the outer margin 88 of the boss 72. The boss 72 is sized to snap snugly into the boss receiving cavity 74 of an adjacent carrier 10 with a force fit.

Each boss receiving cavity 74 is defined by opposed arcuate walls 90, 92 opposed flexible tension channels 94, 96 and circular well 98. The tension channels 94, 96 extend inwardly and horizontally from the vertical side walls 100, 102 of the recessed opening 48. The arcuate walls 90, 92 are molded to the tension channels 94, 96 and are of a curvature and vertical distance apart to snugly engage the upper and lower curved surfaces 80, 82 of boss 72 of an adjacent carrier 10. The circular well 98 is centered between the arcuate walls 90, 92.

Referring to FIGS. 3–9, the front-to-back joining mechanism 28 includes an upper front-to-back joining mechanism 104 carried by the upper portion 20 and a lower front-to-back joining mechanism 106 carried by the base 22. The upper front-to-back joining mechanism 104 includes a rectangular protrusion 108, opposed protrusion receiving guide 110, a horizontal bar 112 extending along the back face 34 of the test tube carrier 10 and a complementary bar receiving channel 114 presented by the front face 32 of the test tube carrier 10. The rectangular protrusion 108 presents opposed beveled edges 116, 118. The rectangular protrusion 108 is sized to fit snugly into the protrusion receiving guide 110 of an adjacent test tube carrier 10. The protrusion receiving guide 110 includes opposed ledges 120, 122 presented by the viewing slot 30. The horizontal bar 112 extends along the back face 34 opposed to the bar receiving channel 114.

The lower joining mechanism 106 includes a generally rectangular knob 124 carried along the back face 34 of the carrier 10. The knob 124 presents beveled margins 126, 128 and is sized to fit snugly into the viewing slot 30.

The viewing slot 30, presented along the front face 32 of the test tube carrier 10, extends from the upper portion 20 of the test tube carrier 10 into the base 22. Opposed slot side walls 130 extend along and define viewing slot 30.

Figure 10:
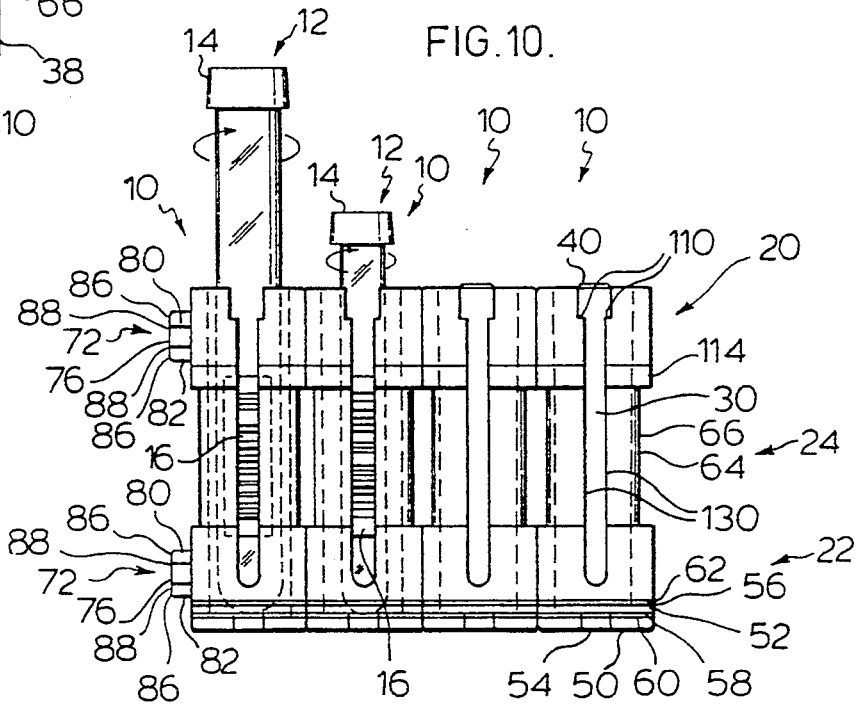
FIG. 10 is a front elevational view showing a plurality of carriers connected together along a single axis.
Figure 11:
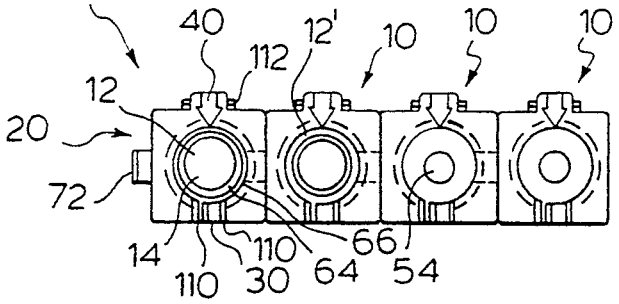
FIG. 11 is a top plan view of a plurality of carriers connected together along a single axis.

In operation, the test tube carrier 10 can be connected to adjacent test tube carriers 10 as depicted in FIGS. 10 and 11. A plurality of test tube carriers 10 are depicted in FIGS. 10 and 11 as connected in a row through the side-to-side coupling mechanism 26. The side-to-side coupling mechanism 26 connects two adjacent test tube carriers 10 together by the snapping of the boss 72 of the upper coupling mechanism 68 and the boss 72 of the lower coupling mechanism 70 of a first carrier 10 into the corresponding boss receiving cavities 74 on the upper portion 20 and base 22 of an adjacent, second carrier 10.

As depicted in FIG. 10, the test tube receiving cavity 46 is of sufficient diameter to rotate test tubes 12 placed within the test tube receiving cavity 46 so that the bar code label 16 is easily visible through viewing slot 30. Any spillage or moisture on the test tube 12 can pass outside the carrier 10 through the drainage passage 54.

Referring to FIG. 11, the bosses 72 of the upper coupling mechanism 68 and lower coupling mechanism 70 of each carrier 10 have been connected to the corresponding boss receiving cavities 48 of the adjacent test tube carrier 10. The beveled edges 86 of each boss 72 guide the bosses 72 into a force fit with each respective boss receiving cavity 74. The tensions channels 94, 96 urge the arcuate walls 90, 92 snugly against the upper and lower curved surfaces 80, 82 of each boss 72. It will be noted in FIG. 11 that the two test tube carriers 10 on the far left contain test tubes 12, 12′ of different sizes while the two test tube carriers 10 on the right are empty.

Figure 12:
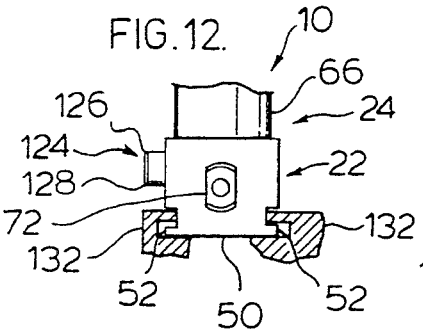
FIG. 12 is a fragmentary, right side elevational view depicting the carrier held within a tracked receiver.
Figure 13:
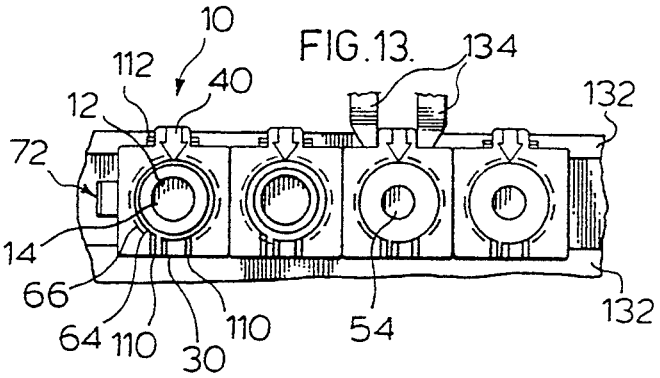
FIG. 13 is a top plan view depicting a plurality of carriers connected together along a single axis received within a tracked receiver, and depicting one of the carriers engaged by robotic selector elements.

Referring to FIG. 12, the opposed track receiving grooves 52 are operably engaged by the carrier engaging tracks 132 for movement of the carrier along a predetermined path by automated handling equipment. The flared ends 60, 62 of the track walls 56, 58 guide the track receiving grooves 52 into operable engagement with the tracks 132.

Figure 14:
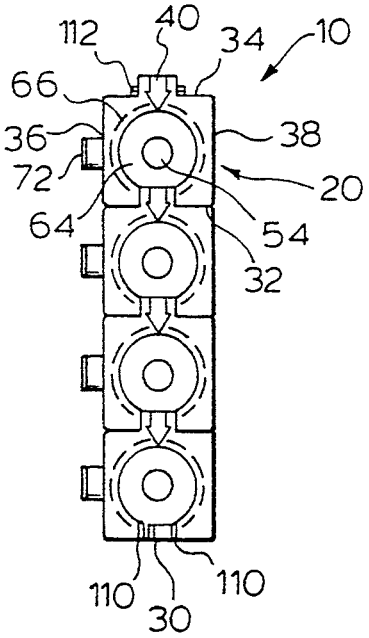
FIG. 14 is a top plan view of a plurality of carriers connected along a single axis different from the axis of connection depicted in FIGS. 10, 11 and 13.

The front-to-back joining mechanisms 42 of adjacent carriers 10 are depicted in FIG. 14 as connecting a plurality of test tube carriers 10 in a column. The front-to-back joining mechanisms 42 connect each test tube carrier 10 to an adjacent test tube carrier 10 by the insertion of the rectangular protrusion 108 of respective upper joining mechanisms 104 snugly into the opposed protrusion receiving guides 110 of adjacent test tube carriers 10 and by the fitting of the rectangular knob 124 of the lower joining mechanisms 106 snugly into the lower portion of the viewing slot 30 of adjacent test tube carriers 10. In addition, the horizontal bar 112 of respective carriers are received into the bar receiving channel 114 of adjacent test tube carriers 10.

Figure 15:
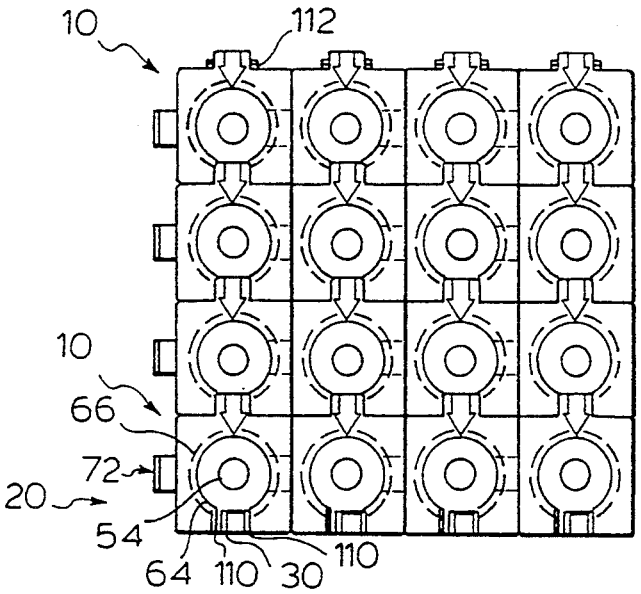
FIG. 15 is a top plan view of a plurality of carriers connected into a two axis matrix.

Referring to FIG. 15, a plurality of test tube carriers 10 are joined in a two axis matrix. Note that the embossed arrow 40 readily identifies the front of each carrier 10.

Having disclosed the subject matter of this invention, it should be apparent that many substitutions, modifications, and variations of the invention are possible in light of the above teachings. It is therefore to be understood that the invention as taught and described herein is only limited to the extent of the breath and scope of the appended claims.

We claim:

1. A test tube holding device constructed and arranged selective intercoupling with other identical holding devices for organized storage of a plurality of test tubes, each of said test tubes presenting a test tube longitudinal axis, comprising:

holding means defining an elongated test tube receiving cavity for carrying said test tube;

coupling assembly means carried by said holding means for selective side-by-side and front to back coupling of said holding device to other identical ones of said holding devices;

an elongated slot in said holding means for viewing of said test tube along a substantial portion of said test tube longitudinal axis;

said holding means presenting a first holding means axis transverse to said elongated slot, said coupling assembly means including coupling means for coupling said holding device to other identical ones of said holding devices along said first holding means axis, whereby the longitudinal axis of each of said plurality of test tubes carried by a plurality of said holding devices joined together by said respective coupling assembly means along said first holding means axis are exposed for viewing;

said holding means including a second holding means axis transverse to said first holding means axis and said slot, said coupling assembly means including joining means for joining said holding devices along said second axis for two dimensional coupling of said test tube holding devices and storage of said test tubes; and wherein said joining means includes at least one protrusion carried by said holding means opposite to said slot, said protrusion being constructed and arranged for mateble reception within the elongated slot of an adjacent one of said holding devices.

2. The holding device as claimed in claim 1, wherein said coupling means includes at least one boss and at least one opposed boss receiving cavity carried by said holding means for mateable coupling of adjacent ones of said holding devices along said first holding means axis.

3. The holding device as claimed in claim 2, wherein the boss and boss receiving cavity of adjacent ones of said holding devices are detachably couplable together in a force fit.

4. The holding device as claimed in claim 1, wherein said joining means further includes a horizontal bar extending along a back face of each of said holding device constructed to fit snugly into a complementary bar receiving channel on a front face of each said holding device.

5. The holding device as claimed in claim 1, wherein said at least one protrusion includes opposed bevelled edges.

6. The holding device as claimed in claim 1, further comprising opposed track receiving grooves on said holding means, said grooves being oriented parallel to said first holding axis, for engagement by carrier engaging tracks for movement of said holding devices in an automatic handling equipment while maintaining a predetermined orientation of said holding devices.

* * * * *